US005882228A

United States Patent [19]

Kobler

[11] Patent Number: 5,882,228

[45] Date of Patent: Mar. 16, 1999

[54] SELF-TERMINATING ELECTRICAL CONNECTOR ASSEMBLY

[75] Inventor: Robert James Kobler, Harrisburg, Pa.

[73] Assignee: The Whitaker Corporation, Wilmington, Del.

[21] Appl. No.: 768,875

[22] Filed: Dec. 17, 1996

[51] Int. Cl.[6] ..... H01R 13/66

[52] U.S. Cl. ..... 439/620

[58] Field of Search ..... 439/620, 944; 29/854, 878, 879

[56] References Cited

U.S. PATENT DOCUMENTS

| | | | |
|---|---|---|---|
| 4,582,385 | 4/1986 | Couper et al. | 339/147 R |
| 4,660,907 | 4/1987 | Belter | 339/14 R |
| 4,687,446 | 8/1987 | Birch et al. | 439/553 |
| 4,772,221 | 9/1988 | Kozlof | 439/549 |
| 5,030,122 | 7/1991 | Birch et al. | 439/188 |
| 5,073,123 | 12/1991 | Birch et al. | 439/188 |
| 5,141,455 | 8/1992 | Ponn | 439/620 |
| 5,213,522 | 5/1993 | Kojima | 439/620 |
| 5,387,116 | 2/1995 | Wang | 439/188 |
| 5,397,252 | 3/1995 | Wang | 439/620 |

*Primary Examiner*—Neil Abrams
*Assistant Examiner*—Katrina Davis
*Attorney, Agent, or Firm*—Katherine A. Nelson

[57] ABSTRACT

An electrical connector assembly (10) includes a housing (24) having an inner terminal (50) with a spring biasing member (54), an outer conductive shell (14), and an electrical component (60) having electrodes (62) on ends thereof disposed in a recess (28) of the housing (24). The recess (28) is adjacent an inner surface of the shell (14) and the spring biasing member (54). The component is completely enclosed within the assembly (10) and is biased against the shell (14) with the electrodes (62) thereof in electrical engagement with the biasing member (54) and the inner surface of the shell (14). The improvement comprises a soldered connection (64) between the biasing member (54) and one of the electrodes (62) of the component (60) whereby the soldered connection assuredly maintains the position of the component (60) during the assembly process and thereafter.

2 Claims, 2 Drawing Sheets

SELF-TERMINATING ELECTRICAL CONNECTOR ASSEMBLY

FIELD OF THE INVENTION

This invention is directed to electrical connectors and more particularly to connectors incorporating an electrical component.

BACKGROUND OF THE INVENTION

U.S. Pat. Nos. 5,030,122 and 5,073,123 disclose self-terminating connector assemblies that are used, for example, in local area networks that interconnect computer work stations where the connector self-terminates to prevent disruption of the network when a work station is disconnected from the network. Both patents disclose connectors having two switches with one switch contact engaged to an electrical article. The connectors include a two piece conductive shell, a two piece switch terminal supported by a dielectric housing, and a circuit element or electrical component, such as a resistor, capacitor or the like, having electrodes on the ends thereof disposed in a recess of the housing adjacent to the inner surface of the shell. The electrical component provides a fixed impedance for the self-terminating connector assembly. The component is biased against the shell by one of the switch contacts. The other switch contact or terminal is electrically connected to a cable or other electrical equipment Upon withdrawal of a terminal of a complementary mating connector from the switch, the switch terminal is terminated electrically to the outer shell through the electrical component thus avoiding disruption of the transmission of communication signals.

In assembling the connector, as shown in these patents, the electrical terminals are disposed in respective slots in the housing with the biasing terminal exposed at the recess in the housing. The electrical component having electrodes on opposite ends thereof is disposed in the recess with one of the electrodes in engagement with the biasing member. The conductive shells are then disposed over the dielectric housing by inserting the ends of housing into respective cylindrical portions of the two shells. For final assembly, it is necessary to depress the electrical component against the spring biasing terminal while simultaneously moving the two shell units into position around the housing and above the other electrode of the electrical component. The assembly requires considerable manual dexterity to assure that the electrode of the component is maintained in its proper position against the biasing member of the switch terminal both during and after assembly. Owing to the difficulty of assembly, this component sometimes moves from its proper position thus causing the connector to malfunction. Furthermore once the assembly has been completed, it is not possible to determine visually that the electrical component is in its proper position.

Additionally, even if the component is initially in the correct position, intermittent failures may occur if the component in the connector changes its position a sufficient amount when in use. This can occur if the assembly is subject to vibrations, inadvertently dropped or otherwise subjected to sufficient external forces to dislodge the component from engagement with the biasing member. It is desirable, therefore, to have a more assurable means of locating the electrical component in the connector.

SUMMARY OF THE INVENTION

The present invention is directed to overcoming problems associated with the prior art. The improved electrical connector assembly includes a housing having an inner terminal with a spring biasing member, an outer conductive shell, and an electrical component having electrodes on the ends thereof disposed in a recess of the housing. The recess is adjacent the inner edge of the shell and the spring biasing member. The recess is adjacent the inner edge of the shell and the spring biasing member. The component is completely enclosed within the assembly and biased against the shell with the electrodes thereof an electrical engagement with the biasing member and an inner surface of the shell. The improvement comprises a soldered connection between the biasing member and one of the electrodes of the component. The soldered connection assuredly maintains the position of the component between the biasing member and the shell during the assembly of process thereby assuring that the electrical connection between the inner terminal and the component is maintained both during and after the assembly process.

An embodiment of the invention will now be disclosed with reference to the following drawings.

DETAILED DESCRIPTION OF THE DRAWINGS

For purposes of illustrating the invention, the electrical connector shown is a self-terminating connector 10m and cable assembly It is to be understood that the invention may be used with other connectors as well.

Figure 1:
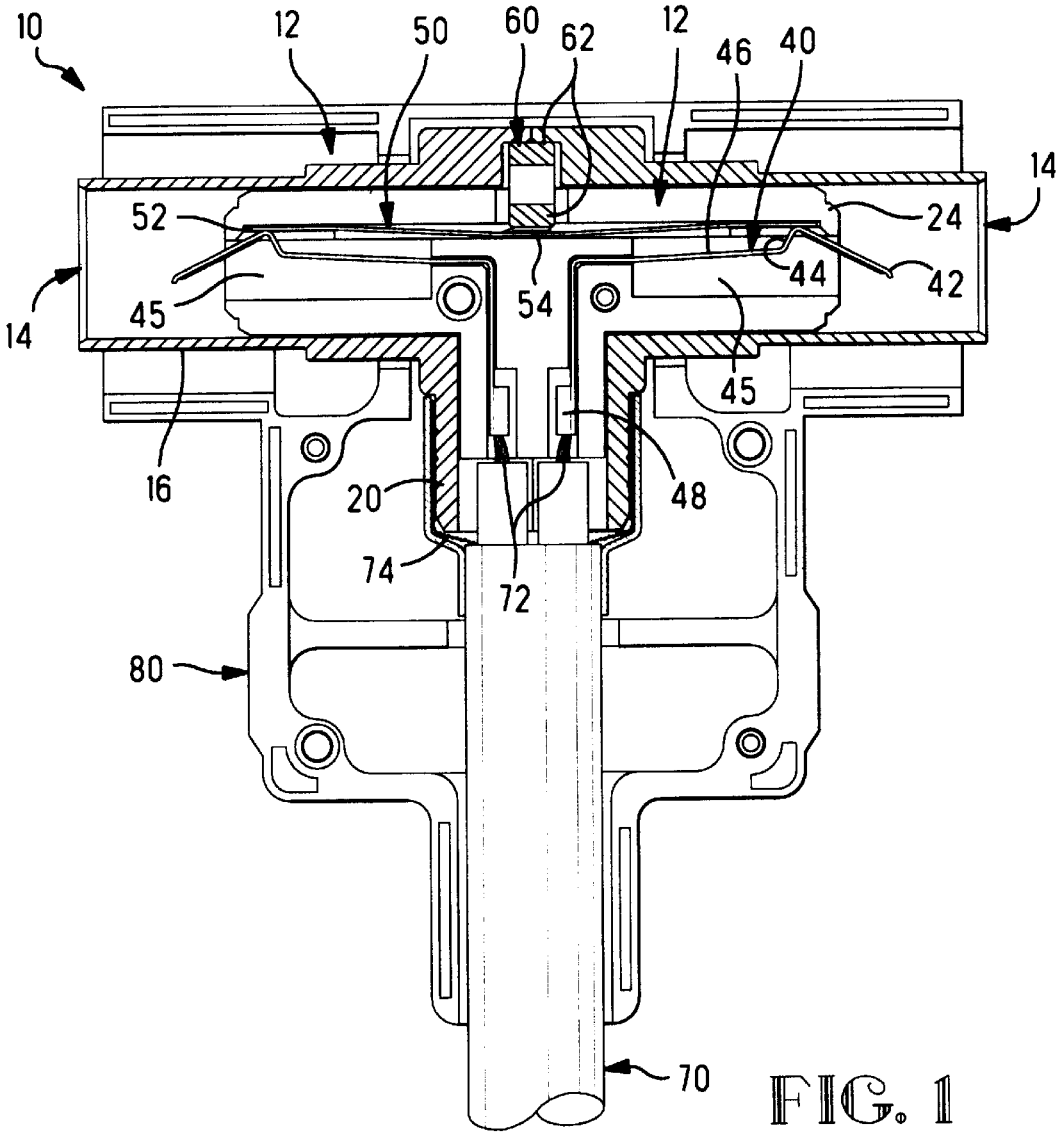
FIG. 1 is a cross sectional view of a connector made in accordance with the invention.
Figure 3:
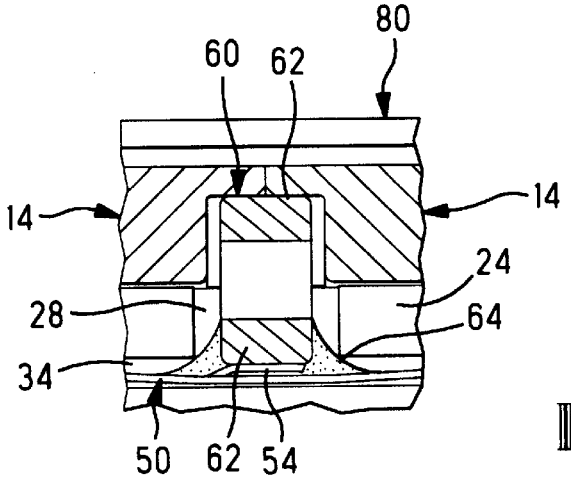
FIG. 3 is an enlarged fragmentary portion of the connector assembly.
Figure 2:
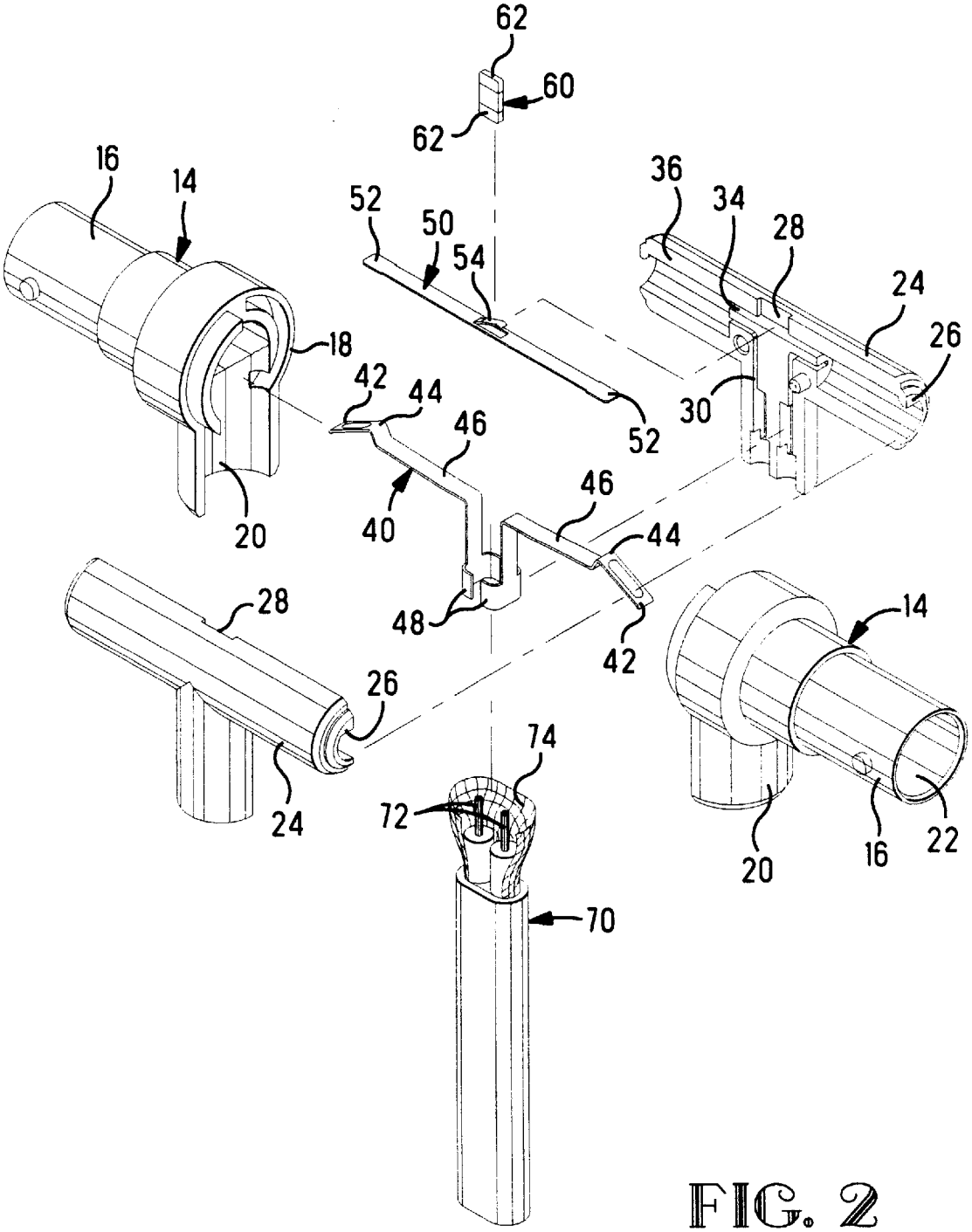
FIG. 2 is an exploded view of the connector of FIG. 1.

Referring now to FIGS. 1, 2 and 3, connector assembly 10 includes two shielded electrical connectors 12 operative as separate electrical connectors with their dielectric housings joined together as shown in U.S. Pat. No. 5,030,122. Each connector 12 includes two conductive shells 14, two dielectric housing sections 24 for assembly into the shells 14, a conductive switch having first and second terminals 40, 50 to be carried by the housing sections 24 and an electrical circuit component 60. Shell 14 includes a cylindrical portion 16 dimensioned to be disposed over a portion of the dielectric housing 24 and an open end 18 for connecting to a corresponding open end 18 of another shell 14 as described in U.S. Pat. No. 4,687,446. The other ends of cylindrical portions 16 are dimensioned to receive a mating connector, as shown in U.S. Pat. No. 5,030,122. The shells 14 in the assembled connector are in intimate contact to ensure gap free shielding and a continuous electric path along a short distance from one shell 14 to the other. In the embodiment shown, the semi-cylindrical portions 20 of corresponding shells 14 connect together to surround a cable 70, as shown in FIG. 1.

The housing includes two half sections 24 that separate to enable assembly of the connector and face each other when assembled in the corresponding shells 14. The assembled housings extend to cavities 45 dimensioned to receive the ends of the switch terminals 40, 50. The housing sections 24 extend to open ends 26 defining half of the respective cavities 45. The housing sections 24 further include a recess 28 for receiving electrical component 60 therein. Housing sections 24 include a first terminal receiving passageway 30 and a second terminal receiving passageway 34. The second terminal receiving passageway 38 communicates with the recess 28 in the housing section 24.

Each switch includes a first switch terminal 40 having a forward sloped end 42 dimensioned to extend outwardly from the housing cavity 45 and to connect with a mating connector, as shown in U.S. Pat. No. 5,030,122, a curved second contact surface 44 for engaging the second switch terminal 50, an elongated leaf spring 46, and an electrical terminal 48 at the opposite end thereof for terminating to a signal conductor 72 of cable 70. The second switch terminal 50 is an essentially straight member extending to ends 52 and further having a spring finger 54 in the center thereof for providing a spring biasing member against an electrode 62 of an electrical component 60, as shown in FIGS. 1 and 3. When second terminal 50 is assembled into second terminal passageway 34, the ends 52 thereof are received in an undercut portion 36 of each section 24 of the dielectric housing thus restraining them from movement. As can be seen in FIG. 2, the spring finger 54 extends upwardly and partially into the recess 28 in housing portions 24. Spring finger 54 provides an increased normal force between the component 60 and the shell member 14 in the assembled connector 10 to assure that there is electrical connection therebetween. Electrical component 60, such as resistor or the like, includes electrodes 62 at opposed ends thereof, one in engagement with spring finger 54 and the other in engagement with an inner surface of the shell 14. In the improved connector assembly 10, one electrode 62 is soldered at 64 to spring finger 54 thus assuring that component 60 will not be moved from engagement with the spring finger 54 if connector assembly 10 is dropped or subjected to vibrations or the like. The soldered connection substantially eliminates the problem of intermittent electrical failures caused by the component changing its position inside the connector.

In assembling the connector in accordance with the invention, one of the electrodes 62 of the electrical component 60 is soldered at 64 to the spring finger 54 prior to disposing second terminal 50 into the corresponding second terminal passageway 34, securing the ends 52 thereof in under-cut portions 36 and disposing electrical component 60 in the recess 28. When assembling first switch terminal into the first terminal receiving passageway 30, the intermediate leaf spring section 46 is deflected in the cavity 45 such that the second contact surface 44 is engaged against the second terminal 50 proximate the ends 52 thereof. The sloped ends 42 of the first terminals 40 extend outwardly from the dielectric housing 24 and into the mating cavity portion 22 of the shell 14 in the assembled connector.

As shown in FIG. 1, there are two first terminal sections 40, one for each of the signal conductors 72 in cable 70. It is to be understood that the first terminal 40 can be a continuous piece such as shown in the tap connector in U.S. Pat. No. 5,073,323. The curved second contact surface 44 is in pressure engagement with the second terminal 50 to establish an electrical circuit that couples a corresponding signal transmitting conductor 72, through the switch, the electrical component 60 and a corresponding shell 14. The circuit also extends along the other switch terminal 50.

In assembling the shells 14 to the assembled dielectric housing and terminals, the cylindrical portions 22 are moved along the outer surfaces of housings 24 until the leading edges 26 abut each other. In order to bring the shells 14 completely together, it is necessary to deflect the component 60 and spring finger 54, which have been soldered together at 64. The assembler, however, no longer needs to hold a loose component 60 in position on spring finger 54 to assure that the electrode does not become disengaged from the spring finger as the shell members 14 are brought together. The soldered connection between electrode 62 and spring finger 54 assures that the electrical component 60 remains in electrical engagement with the spring finger 54. The finger 54 provides sufficient normal force between the component 60 and the shell 22 to assure electrical connection therebetween.

The present invention overcomes some of the problems associated with the assembly of a complicated structure and provides the desired electrical continuity to assure that the switch functions as designed.

It is thought that the electrical connector assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector assembly including a housing having an inner terminal with a spring biasing member, an outer conductive shell, and an electrical component having electrodes on ends thereof disposed in a recess of said housing, said recess being adjacent an inner surface of said shell and the spring biasing member, said component being completely enclosed within the assembly biased against the shell with electrodes thereof in electrical engagement with said biasing member and said inner surface of said shell; said improvement comprising:

a soldered connection between said biasing member and one of said electrodes of said component;

whereby said soldered connection assuredly maintains the position of the component biased between the biasing member and the shell during the assembly process thereby assuring the electrical connection between the inner terminal and the component during and after the assembly process.

2. A method for making an electrical connector assembly including the steps of:

providing a terminal with a spring biasing member;

providing an electrical component having electrodes on ends thereof;

soldering one of said component electrodes to said spring biasing member;

providing a housing having a terminal receiving passageway and a recess adapted to receive an electrical component having electrodes on ends thereof, said recess being adjacent the terminal receiving passageway and extending to an outer surface of said housing;

disposing said terminal in said terminal receiving passageway and said component in said recess; and disposing an outer conductive shell around said housing such that said component is completely encased in the assembly and said other electrode of said component is biased against an inner surface of said shell when said connector is fully assembled, whereby said soldered connection assuredly maintains the position of the component biased between the biasing member and the shell during the assembly process thereby assuring the electrical connection between the inner terminal and the component during and after the assembly process.

* * * * *